US006662764B2

(12) United States Patent
Chen et al.

(10) Patent No.: US 6,662,764 B2
(45) Date of Patent: Dec. 16, 2003

(54) TWO STROKE ENGINE

(76) Inventors: Yung-ching Chen, #6, Chang Ping East 6th Road, Hsien Hsi Shang, Changhua (TW); Chih-chieh Chen, #6, Chang Ping East 6th Road, Hsien Hsi Shang, Changhua (TW)

( * ) Notice: Subject to any disclaimer, the term of this patent is extended or adjusted under 35 U.S.C. 154(b) by 61 days.

(21) Appl. No.: 10/138,270

(22) Filed: May 6, 2002

(65) Prior Publication Data

US 2003/0205212 A1 Nov. 6, 2003

(51) Int. Cl.[7] ..... F02B 25/14
(52) U.S. Cl. ..... 123/65 R
(58) Field of Search ..... 123/65 R, 74 R, 123/65 A, 65 W, 65 P, 193.6, 193.4, 193.2, 65 PE, 65 E, 70 V, 70 R

(56) References Cited

U.S. PATENT DOCUMENTS 2,458,111 A * 1/1949 Soltesz ..... 123/78 R
4,576,126 A * 3/1986 Ancheta ..... 123/41.38
4,663,938 A * 5/1987 Colgate ..... 60/620
6,145,488 A * 11/2000 Plechner ..... 123/193.1

FOREIGN PATENT DOCUMENTS

EP 1300556 A1 * 4/2003 ..... F02B/25/14

* cited by examiner

*Primary Examiner*—Henry C. Yuen
*Assistant Examiner*—Hyder Ali
(74) *Attorney, Agent, or Firm*—Rabin & Berdo, P.C.

(57) ABSTRACT

This invention relates to an improvement of two stroke engine in which a sleeve piston is employed to move up and down in the cylinder and to control alternatively the opening and closing of the intake guide and exhaust guide and to prevent the lubricant from exuding out of the crank case in an effort to ensure an environmental-friendly clean exhaust.

4 Claims, 4 Drawing Sheets

TWO STROKE ENGINE

FIELD OF THE INVENTION

This invention relates to the two stroke engine, mainly an improvement to reduce the high pollution contained in the exhaust, a dominant weakness the traditional two stroke engine has ever embraced. Particularly, it requires no mixing of engine oil to be added during the refilling with gasoline.

BACKGROUND OF THE INVENTION

Please refer to FIGS. 1 and 2. They are schematic diagrams showing the general two stroke engine where the cylinder 10 provides an intake way 11 and an exhaust way 12 at the opposed direction. A piston 13 has a piston ring 131 installed on the piston crown to choke the gasoline mixture with the cylinder 10. A connecting rod 14 has a piston pin 15 at one end being locked in the piston 13 and the other end connected to the crankshaft 17 within the crank case 16. When the piston 13 comes up and compresses the gasoline mixture in the combustion chamber of cylinder 10, an explosion follows as the spark plug 18 ignites the compressed gasoline mixture, and the piston 13 is thus moved down. When the piston 13 moves down to the exhaust way 12, the exhaust flows out right at this moment. The flowing of the exhaust through the exhaust way 12 will create a venturi effect and a negative pressure in the combustion chamber in the cylinder 10 as compared with the preset pressure in the crank case 16, the gasoline mixture will be sucked into the cylinder 10 through the intake way 11 (with one way valve), and the piston 13 and the connecting rod 14 will continue to move up by the rotary force of the crankshaft 17 to proceed the second compress ion and explosion and so on. It is easy to learn that the two stroke engine is simple in construction, less loss in power, benefiting greater horsepower and long service time. In down movement of the piston 13, because there exist an intake way 11 and an exhaust way 12 on both sides, there is no way to reserve the engine oil in the crank case 16. Therefore, the engine oil has to be added to the gasoline while refilling where the engine oil will form a lubricating film along the piston after explosion, resulted in an incomplete combustion, a culprit for pollution.

FIG. 3 shows a schematic diagram of a four stroke engine, where the engine oil is stored in the crank case 16, and intake way 20 and the exhaust way 21 are moved to the top of the cylinder 10. When the piston 13 moves upward in the cylinder 10, it is not necessary for the piston 13 to bring up the engine oil to the intake way 20 and exhaust way 21, the four stroke engine entails no engine oil to be mixed with the gasoline, a complete combustion is therefore achieved and the exhaust is more environmental-friendly. However, in the four stroke engine, the intake valve 20 and the exhaust valve 21 need to be controlled by the camshaft (not shown), inefficiency caused by a complicated mechanism, heavy consumption of energy and less horsepower is unavoidable.

Comparing the merits and demerits between the two stroke engine and the four stroke engine, after many years' endeavor to the research and development, tests and experiments, the inventor has come up a practicable two stroke engine in which all merits are conserved and all demerits are removed in an attempt to upgrade the motorcycle industry and to solve the pollution the motorcycle yields.

SUMMARY OF THE INVENTION

The invention mainly employs a sleeve piston structure over the main piston which serves to block the engine oil from arousing to the intake way and exhaust way along the piston wall while the piston moves up. It therefore requires no adding engine oil to the gasoline to ensure a clean exhaust pursuant to the emission standard set forth by environmental protection requirements.

The invention is explained in great details with the aid of the preferable embodiments as presented in the drawings.

DETAILED DESCRIPTION OF THE INVENTION

Figure 2:
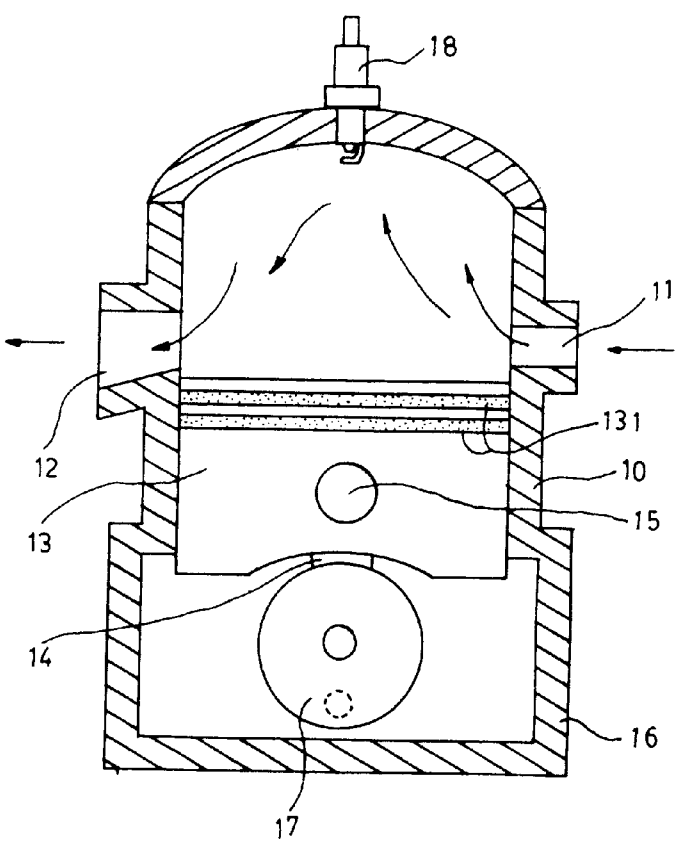
Fig. 2 PRIOR ART
FIG. 2 is the schematic diagram showing the prior art of the two-stroke engine (in intake and exhaust stage).
Figure 1:
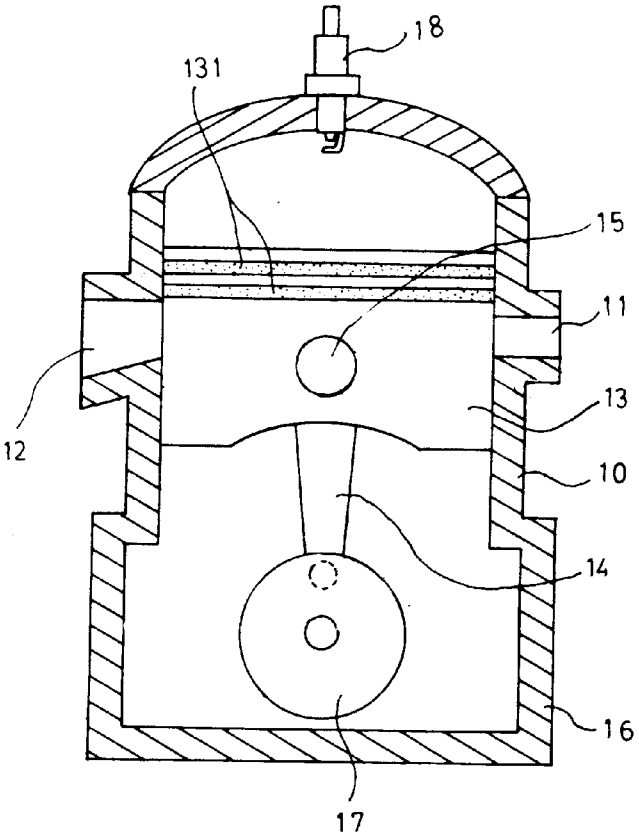
Fig. 1 PRIOR ART
FIG. 1 is the schematic diagram showing the prior art of the two-stroke engine (in compression and ignition stage).
Figure 4:
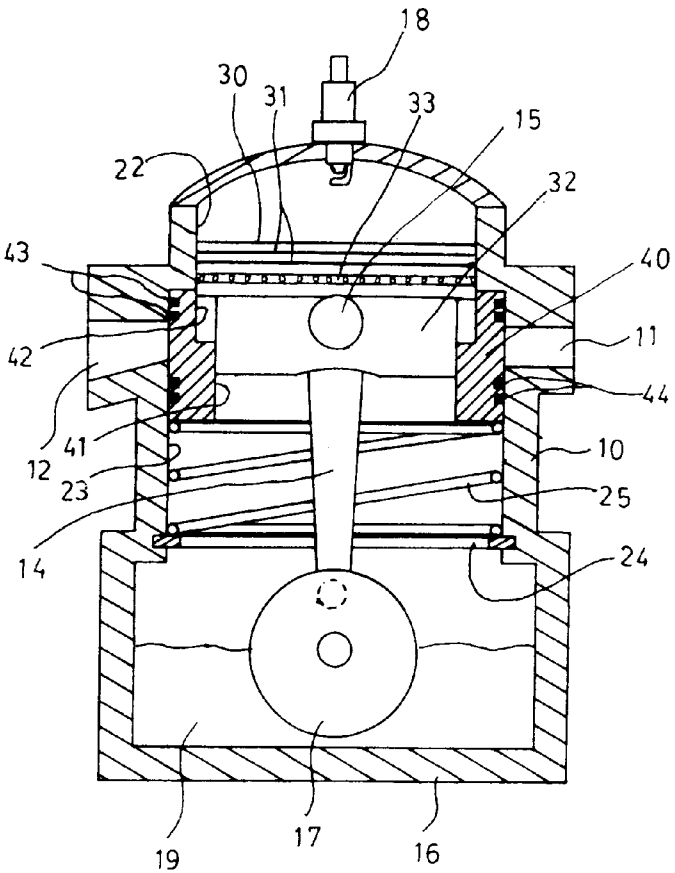
FIG. 4 is the schematic diagram showing the two-stroke engine of the invention (in compression and ignition stage).
Figure 3:
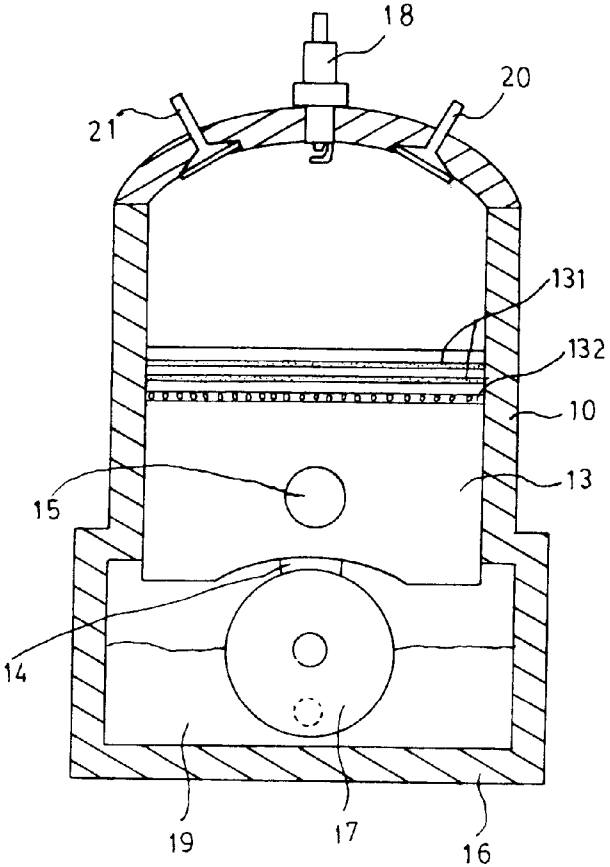
Fig. 3 PRIOR ART
FIG. 3 is a schematic diagram of four-stroke engine.
Figure 6:
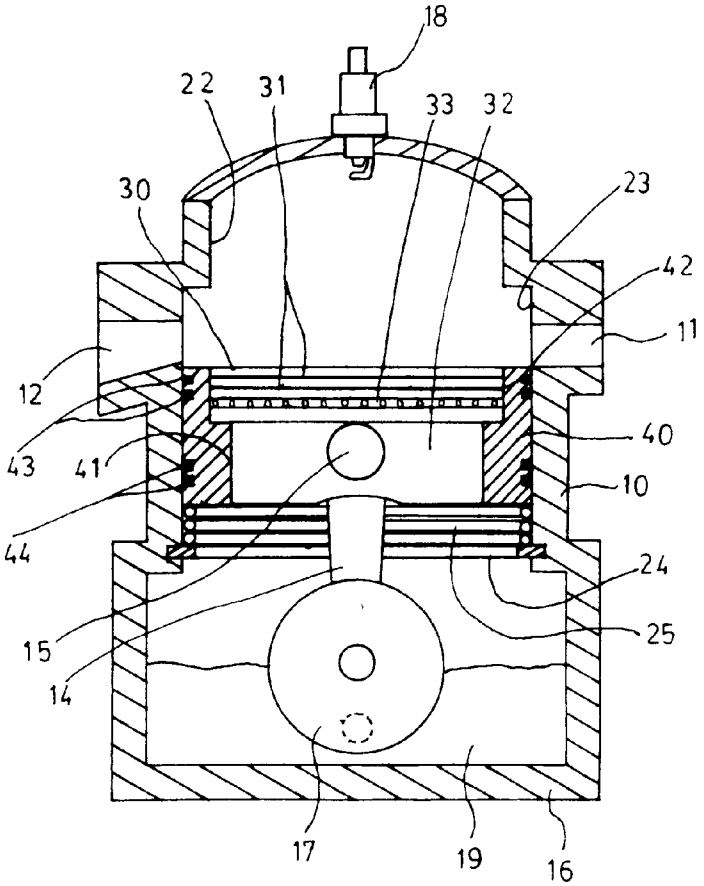
FIG. 6 is the schematic diagram showing the two-stroke engine of the invention (in intake and exhaust stage).
Figure 5:
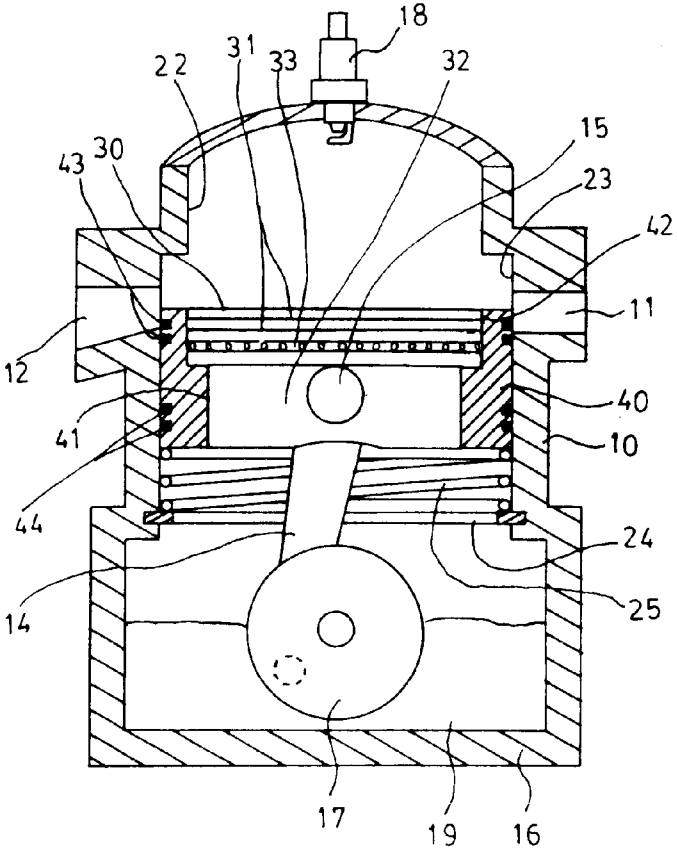
FIG. 5 show the sleeve piston assembly is moving downward.

As shown in FIGS. 4, 5, and 6, the structure and technique of the two stroke engine of the invention are similar to the prior art of the two stroke engine, except with better improvement. In the interior of the cylinder 10, there is a sleeve piston over wrapped on the main piston. The sleeve piston moves up and down in the cylinder 10, which controls the opening and closing of the intake way 11 and exhaust way 12 and blocks the engine oil from exuding from the crank case 16, so that it is no longer required to mix engine oil 19 with the gasoline while refilling to gain a better clean exhaust in accordance with the environmental protection standards. The major characteristics of the invention are as follows.

The sleeve piston comprises a main piston 30 and a sleeve piston 40, wherein the main piston 30 has provided a piston ring 31 and an oil ring 33 serving as a seal. The lower part of the piston 30 has a taper 32.

The sleeve piston 40 has an internal chamber 41, a large inner diameter groove race 42 and sealing rings 43 and 44.

When the taper 32 of the main piston 30 is inserted into the chamber 41 of the sleeve piston 40, it forms a complete sleeve piston assembly.

To fit the sleeve piston of the invention, the cylinder 10 is hereby designed into two sections where the inner diameter of the first section 22 of the cylinder 10 is tantamount to the outer diameter of the main piston 30, and so the diameter of the second section 23 of the cylinder equals to the outer diameter of the sleeve piston 40. The intake way 11 and the exhaust way 12 are located at the highest place within the second section 23. The bottom of the cylinder 10 provides a retaining ring 24 employed for holding the compression spring 25 which touches the bottom of the sleeve piston 40 and also offers a uprising force to the sleeve piston 40.

As shown in FIG. 4, the piston 30 is placed in the first section 23 of the cylinder 10, and the compressed gasoline is sealed by the piston ring 31. The sleeve piston 40 is located at the upper dead point of the second section 23 of the cylinder 10, the sealing rings 43, 44 are located below the intake way 11 and exhaust way 12 to stop the engine oil 19 leaking out of the crank case 16 and entering the intake way 11 and exhaust way 12. As shown in FIG. 5, immediately after the spark plug 18 ignites an explosion of the compressed mixture of gasoline and air, the main piston 30 begins to move downward and move into the chamber 41 of the sleeve piston 40 and touches the groove race 42, so as to bring down the sleeve piston 40 together, the intake way 11 and the exhaust way are respectively opened (similar to the prior art of the tow stroke engine), and the spring 25 is compressed. When the main piston 30 arrives at the position as shown in FIG. 6, the rotary force from the crankshaft 17 turns the main piston 30 and the connecting rod 14 upward, and in turn the main piston 30 releases the pushing force exerted on the sleeve piston 40. The spring 25 helps lifting the sleeve piston 40 upward along with the main piston 30 till they arrive at the position as shown in FIG. 4. Then, the sleeve piston 40 closes the intake way 11 and exhaust way 12, and the main piston 30 starts another compression and explosion processing.

Figure 7:
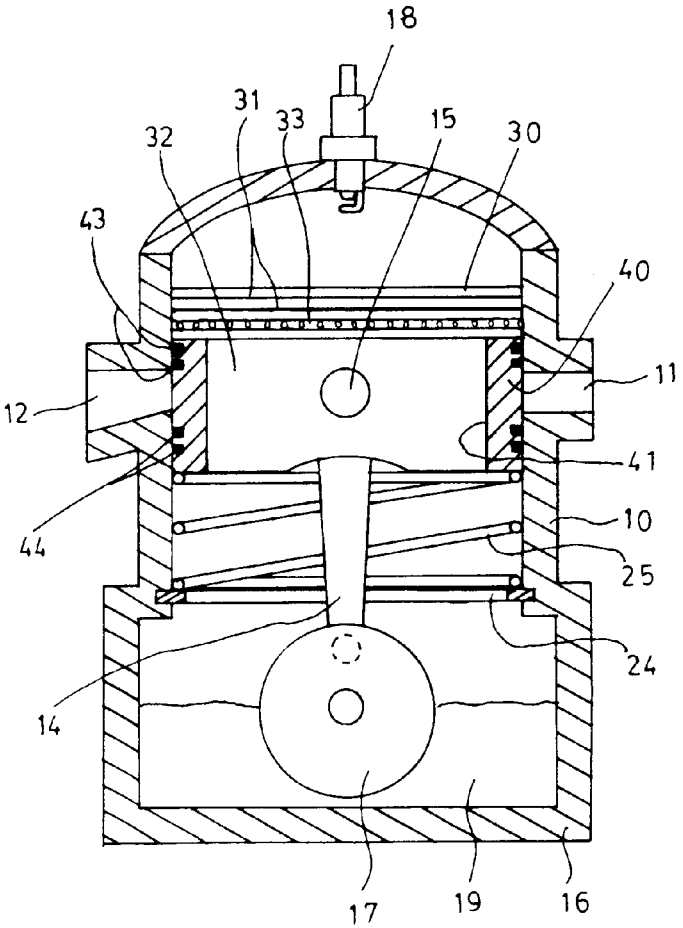
FIG. 7 is another embodiment of two-stroke engine of the invention.

As shown in FIG. 7, it is really a practicable embodiment where the exterior diameter of the sleeve piston 40 equals to that of the main piston 30, and the inner diameter of the chamber 41 which goes through the interior of the sleeve piston 40 equals to outer diameter of the taper 32 of the main piston 30. When the taper 32 of the main piston 30 is inserted into the chamber 41 of the sleeve piston 40, the structure of the sleeve piston can be formed with which the main piston 30 can cause synchronized movement with the sleeve piston 40 as the main pistons 30 moves down.

Many changes and modifications in the sectional design of the cylinder and architecture of sleeve piston of the above-disclosed embodiment of the invention can, of course, be carried out without departing from the scope thereof. Accordingly, to promote the progress in science and the useful arts, the invention is disclosed and is intended to be limited only by the scope of the appended claims.

The two-stroke engine of the invention has removed the weaknesses the prior art of two-stroke engine prevails. It is a novel improvement, which promotes the product value, and is justified for a grant of a new patent.

What is claimed is:

1. An improvement of two stroke engine mainly comprises a sleeve piston over wrapped on the main piston, wherein the sleeve piston controls the opening and closing of the intake way and the exhaust way while the piston moves up and down in the cylinder and block the engine oil from leaking out of the crank case, it is unnecessary to mix engine oil into gasoline for the two-stroke engine of the invention, it produce the clean exhaust, which meets the emission standard, and the main characteristics are:

the sleeve piston comprises a main piston and a sleeve piston;

the main piston has the piston ring serving the sealing function and a taper at the lower part;

the sleeve piston has a chamber with a large size groove race on the top and provides two sealing rings;

the taper of the main piston is inserted into the chamber of the sleeve piston to form an integral sleeve piston assembly.

2. The improvement of two-stroke engine of claim 1, wherein the cylinder is designed in two sections.

3. The improvement of two stroke engine of claim 1, wherein the second section of the cylinder provides a retaining ring to hold a spring which supports at the internal bottom the sleeve piston so as to lift the sleeve piston by its expansion force.

4. The improvement of two-stroke engine of claim 1, wherein the inner diameter of the sleeve piston is tantamount to the outer diameter of the main piston and the inner diameter of the chamber is equal to the outer diameter of the taper of the main piston, after the taper is inserted into the chamber of the sleeve piston, the main piston and the sleeve piston will move synchronically up and down.

* * * * *